US007484449B2

(12) United States Patent
Shim et al.

(10) Patent No.: US 7,484,449 B2
(45) Date of Patent: Feb. 3, 2009

(54) MISSILE EJECTION SYSTEM AND LAUNCHING CANISTER THEREOF

(75) Inventors: Woo-Jeon Shim, Daejeon (KR); Il-Soo Kim, Daejeon (KR); Seung-Jong Oh, Daejeon (KR); Jae-Hoon Ha, Suwon (KR); Ji-Chul Kim, Daejeon (KR)

(73) Assignee: Government Agency for Defense Development, Daejeon (KR)

( * ) Notice: Subject to any disclaimer, the term of this patent is extended or adjusted under 35 U.S.C. 154(b) by 599 days.

(21) Appl. No.: 11/169,022

(22) Filed: Jun. 28, 2005

(65) Prior Publication Data

US 2006/0214062 A1 Sep. 28, 2006

(30) Foreign Application Priority Data

Jul. 30, 2004 (KR) ..... 10-2004-0060405

(51) Int. Cl.
*F41F 3/04* (2006.01)
*F41F 3/042* (2006.01)
*F41F 3/045* (2006.01)

(52) U.S. Cl. ..... 89/1.816; 89/1.818; 89/1.815

(58) Field of Classification Search ..... 89/1.8, 89/1.815, 1.816, 1.818
See application file for complete search history.

(56) References Cited

U.S. PATENT DOCUMENTS 3,088,377 A * 5/1963 Siegel ..... 89/1.81
3,253,511 A * 5/1966 Zwicky ..... 89/1.814
3,548,708 A * 12/1970 Hubigh ..... 89/1.818
4,324,167 A * 4/1982 Piesik ..... 89/1.8
4,671,163 A * 6/1987 Erikson ..... 89/1.81

(Continued)

FOREIGN PATENT DOCUMENTS

JP 5-288494 11/1993

(Continued)

*Primary Examiner*—Bret Hayes
(74) *Attorney, Agent, or Firm*—Scully, Scott, Murphy & Presser, P.C.

(57) ABSTRACT

The present invention discloses a missile ejection system and a canister thereof. The missile ejection system comprises: comprising: a canister formed as a cylindrical shell, a partition wall protruding from an inner wall of the canister so as to divide the canister into a first chamber for housing a missile therewithin and a second chamber, and having at least one hole therethrough for allowing the flowing of gas through the partition wall, a gas generator secured to the partition wall in the second chamber so that a gas outlet thereof faces in an opposite direction from the first chamber, and an obturator including a sealing plate formed with a concave surface toward a fore-end of the missile for enclosing a tail end of the missile, and a radially extending skirt plate extended from the circumference of the sealing plate to the inner wall of the canister and inclined toward the fore-end of the missile for covering the space between the missile and the inner canister, wherein the missile is propelled by the pressure of the gas discharged out of the gas generator from the second chamber to the first chamber through the hole, being pressurized by the flown-in gas in the first chamber, pushing upon the obturator. Thereby, the system is able to effectively release a missile from a canister by a gas generator without using a missile propulsion engine, thereby fundamentally preventing the damage of ground equipments or peripheral missiles.

19 Claims, 13 Drawing Sheets

U.S. PATENT DOCUMENTS

| | | | | | |
|---|---|---|---|---|---|
| 4,796,510 | A * | 1/1989 | Piesik | 89/1.816 |
| 4,944,210 | A * | 7/1990 | Flock et al. | 89/1.818 |
| 5,012,718 | A * | 5/1991 | Miller | 89/1.816 |
| 5,365,913 | A * | 11/1994 | Walton | 124/75 |
| 6,418,870 | B1 * | 7/2002 | Lanowy et al. | 114/238 |
| 7,398,721 | B1 * | 7/2008 | Alberding et al. | 89/1.818 |

FOREIGN PATENT DOCUMENTS

| | | |
|---|---|---|
| KR | 10-2004 0060405 | 7/2003 |
| WO | WO 90/01668 | 2/1990 |
| WO | WO 91/14918 | 10/1991 |
| WO | WO 00/75599 A1 | 12/2000 |

* cited by examiner

MISSILE EJECTION SYSTEM AND LAUNCHING CANISTER THEREOF

BACKGROUND OF THE INVENTION

1. Field of the Invention

The present invention relates to a missile ejection system and a canister thereof, and more particularly relates to a missile ejection system which is capable of fundamentally preventing ground equipment or peripheral missiles from being damaged, by releasing a missile from a canister without using a missile propulsion engine therein.

2. Description of the Background Art

Up to the present, in many countries the majority of missile launching systems have been developed to be of such a type that a missile is released from a canister using a thrust generated by a propulsion ignition engine of the missile. However, in this type of launching system, there is a risk that ground equipment or peripheral missiles in a launcher might be damaged due to the high temperature and high pressure flames from the missile propulsion engine. Accordingly, a flame treatment device or a protective measure is required necessarily for protecting those equipments. Besides, this type of launching system had problems that a thrust loss occurs as a detent is unlocked and a missile is released by using its propulsion engine during the initial launch period.

SUMMARY OF THE INVENTION

Therefore, an object of the present invention is to provide a missile ejection system which is capable of fundamentally preventing ground equipment or peripheral missiles from being damaged by releasing a missile from a canister without using a propulsion engine of the missile, thereby protecting those equipments from flames without need for a flame treatment device or a measure for protection.

To achieve the above-described object, there is provided a missile-ejection system in accordance with the present invention comprising: a canister formed as a cylindrical shell, a partition wall protruding from an inner wall of the canister so as to divide the canister into a first chamber for housing a missile therewithin and a second chamber, and having at least one hole therethrough for allowing the flowing of gas through the partition wall, a gas generator secured to the partition wall in the second chamber so that a gas outlet thereof faces in an opposite direction from the first chamber, and an obturator including a sealing plate formed with a concave surface toward a fore-end of the missile for enclosing a tail end of the missile, and a radially extending skirt plate extended from the circumference of the sealing plate to the inner wall of the canister and inclined toward the fore-end of the missile for covering the space between the missile and the inner canister, wherein the missile is propelled by the pressure of the gas discharged out of the gas generator from the second chamber to the first chamber through the hole, being pressurized by the flown-in gas in the first chamber, pushing upon the obturator.

This is to effectively release a missile from the canister by the gas generator without using any missile propulsion engine by forming an enclosed space between the gas generator and the obturator, and thus, to fundamentally prevent the damage of ground equipment or peripheral missiles.

Preferably, the missile ejection system further comprises a guide formed on the outer circumference of the skirt plate so that the outer circumference thereof is in contact with the inner wall of the canister. This is for achieving a smooth missile ejecting by reducing a friction between the guide and the inner wall of the canister during the advance of the missile. Further, plural guides can be formed.

Furthermore, it is easy to manufacture the partition wall when formed integrally with the canister.

It is desirable that the canister consists of a front cover, a rear cover and a combination of a plurality of tubes between the front cover and the rear cover. With the combination of plurality of tubes, any heavy machine tools are not required and an error rate produced in the manufacture of the canister can be drastically lowered. Further, in the event of moving or storing the canister for an assembly purpose, the size of a unit tube becomes smaller, and thus handling of the canister is made easier.

Herein, tongues and grooves engageable with each other are respectively formed on the ends of the adjacent tubes in order to easily assemble the adjacent tubes to each other. Moreover, tapered recesses are formed in the inner walls of adjacent tubes so as to eliminate a level difference in the inner surfaces of the adjacent tubes.

Furthermore, a support part is formed on at least two tubes thereof in order to make it easier to mount or lay the canister on a launcher, thereby realizing an easy mounting of the ejection system on the launching stand and thus realizing a convenient transportation of the same conveniently.

In an effective way, the missile ejection system further comprises at least one guide rail formed inside the canister along the longitudinal direction of the canister in order to prevent rolling motion of the missile within the canister. In order to achieve this function, the skirt plate of the obturator has at least one guide part which engages the corresponding guide rail.

Preferably, the missile ejection system further comprises at least one detent engaging the tail end of the missile so as to restrain the missile in the longitudinal direction.

It is also effective that the missile ejection system further comprises at least one immobilizer which contacts with a corresponding sabot protruding on the outer peripheral surface of the missile so as to restrain the missile in a transverse direction. Accordingly, a clearance between the missile and the canister is completely eliminated so that a relative motion therebetween is not permitted any longer.

Preferably, the immobilizer further comprises a friction pin urged in contact with the outer peripheral surface of the corresponding sabot.

Further, the missile ejection system further comprises: a connector connected with a peripheral surface of the missile so as to exchange an electric signals between the missile and the outside of the missile; and at least one connection link hinge-coupled between the connector and the inner surface of the canister; wherein, during the missile's launching, the connector connected with the missile moves along the missile and then the connector becomes disconnected from the missile when the connecter cannot follow the missile any longer.

Herein, the missile ejection system comprises an obturator separator, including at least one stop bar provided on the inner surface of the canister, and at least one snatcher formed integrally on an outer circumference of the skirt plate of the obturator and having a receiving part which is aligned with the stop bar so as to receive and engage the stop bar as the missile is ejected from the canister. Therefore, it can eliminate the possibility of damaging the ground objects upon the missile's falling down on the ground after the obturator is released from the canister and separated by the missile propulsion engine.

It is desirable that the stop bar further comprises a deformable member absorbing a shock by plastic deformation.

The a V-shaped plate spring is preferably provided at a front end of the corresponding each stop bar, stopping protuberances protruding inward are formed at an opening of the snatcher so that the opening has a smaller width than the receiving parts does, and when the stop bars are inserted into the receiving parts of the snatcher, the V-shaped plate spring at a front end of the stop bars is contracted and locked with the snatcher so as to prevent from being released. This is for preventing the obturator not released from the canister from being dropped on the bottom of the canister and damaging the inside of the canister.

Additionally, there is provided a canister of a missile ejection system in accordance with the present invention, comprising: a front cover for opening and closing a front portion of a missile; a rear cover for surrounding a rear portion of the missile; and at least two tubes rigidly connected on the ends thereof between the front cover and the rear cover.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
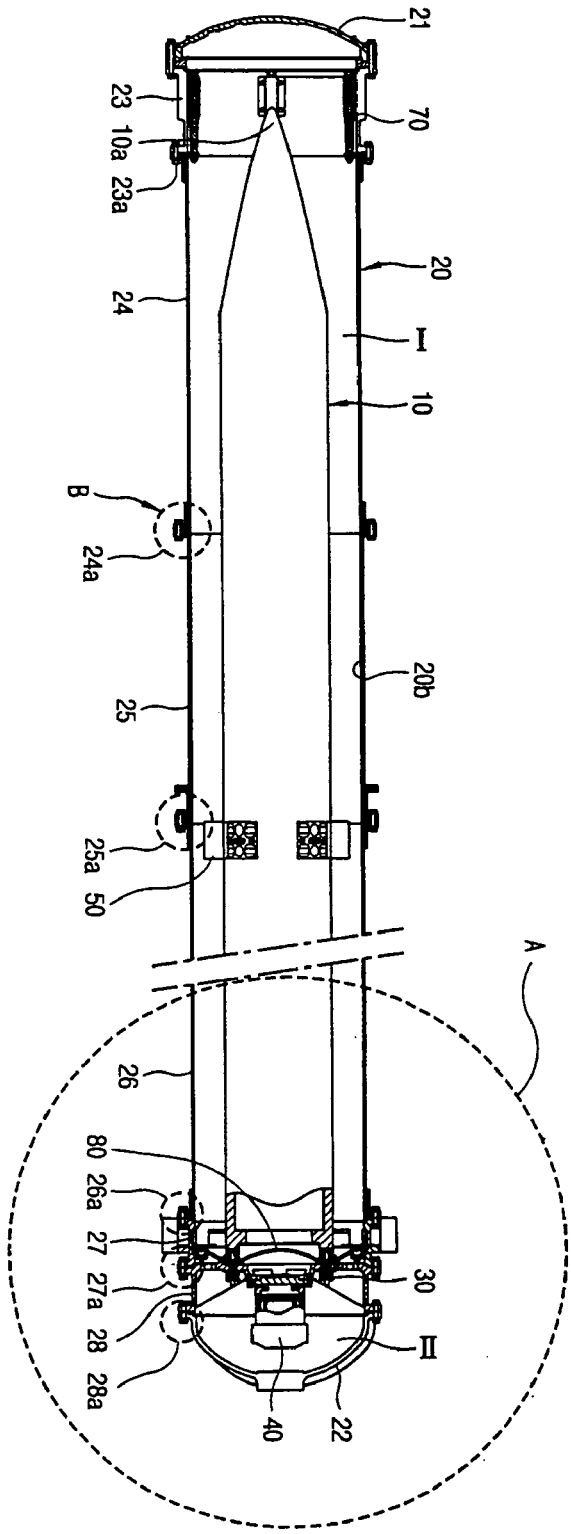
FIG. 1 is a cut away view showing the interior of a missile ejection system in accordance with one embodiment of the present invention.
Figure 2:
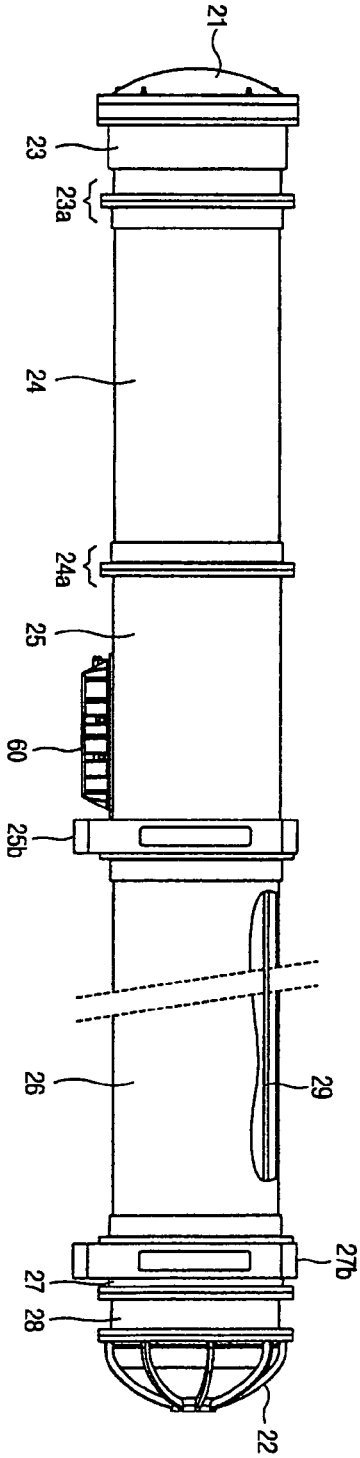
FIG. 2 is a side view showing the exterior of the missile ejection system of FIG. 1.

Hereinafter, the present invention will be described in detail with reference to the accompanying drawings.

Detailed description of well-known functions and structures is omitted in order to clarify the key points of the present invention.

A missile ejection system 1 in accordance with one embodiment of the present invention includes a canister 20 protecting a missile 10 from the exterior disturbance before the launching of the missile 10 and serving as a cylinder during launching of the missile 10, a plurality of detents 30 restraining the missile 10 in the longitudinal direction before the launching of the missile 10, a gas generator 40 generating pressure in order to eject the missile 10 from the canister 20 in the event the missile 10 is launched, a plurality of sabots 50 fitting to the missile 10 in the canister 20 and protruding on the outer peripheral surface of the missile 10, an umbilical cable separator 60 arranged to smoothly separate a nib connector 63 from a peripheral surface of the missile 10 in the event the missile 10 is launched, a plurality of obturator separators 70 mounted in the front portion of the canister 20 so as to separate an obturator 80 attached on the tail end of the missile 10 from the canister 20 in the event the missile 10 is launched, the obturator 80 being placed on the tail end of the missile 10 so as to move integrally with the missile 10 for launching and guiding the missile 10 in the canister 20 by being pushed by a high pressure gas ejected from the gas generator 40, and a plurality of immobilizers 90 arranged to restrain the transverse motion of the missile 10 by contacting with corresponding ones of the sabots 50 protruding on the peripheral surface of the missile 10 in the event the missile 10 in the canister 20 moves in its housed state.

The tail end of the missile 10 is secured longitudinally in the canister 20 by the detents 30. Thus, it is possible to prevent the missile 10 from fluctuating in the longitudinal direction in the canister 20 before launching of the missile 10.

The canister 20 is divided by a partition wall 28*b* into a first chamber I for housing the missile 10 and a second chamber II excluding the first chamber I. The canister 20 which houses the missile 10 mounted in the first chamber I protects the missile 10 from external effects such as humidity and from foreign substances, serves as a cylinder that pushes the missile 10 out when the missile 10 is to be launched, and is provided with a front cover 21 covering the front portion of the missile 10, a rear cover 22 protecting an ejection system and supporting an impact load upon launching, a missile restraining tube 28 connected to the rear cover 22 and mounting the tail end of the missile 10, the gas generator 10 and the like thereon, a plurality of tubes 23 to 27 each formed in a hollow cylindrical shell shape between the missile restraining tube 28 and the front cover 21, tube connecting parts 23*a* to 27*a* connecting between the tubes 23 to 27, and guide rails 29 extended lengthwise on an inner wall of the canister 20 along the longitudinal direction of the missile 10 so as to prevent in cooperation with the obturator 80 the rolling motion of the missile 10 during the missile 10 is ejected.

That is, the first chamber I of the canister 20 is formed by the front cover 21, the plurality of tubes 23 to 27 sequentially connected to the front cover 21 and the partition wall 28*b* of the missile restraining tube 28, and the second chamber II of the canister 20 is formed by the missile restraining tube 28 including the partition wall 28*b* and the rear cover 22.

The canister 20 is formed of the plurality of tubes 23 to 28 in order to manufacture a relatively long canister 20 at a lower cost and to make the manufacture easier and quicker. Conventionally, since a substantially long canister was manufactured in a single unit, many problems occurred such that a huge production facility was required for the manufacture thereof, a high material cost and a processing cost was incurred due to a defect ratio of the manufactured products, and it was very troublesome to carry the canister to an assembly place after the manufacturing. However, the canister of this invention can overcome these problems.

Figure 3:
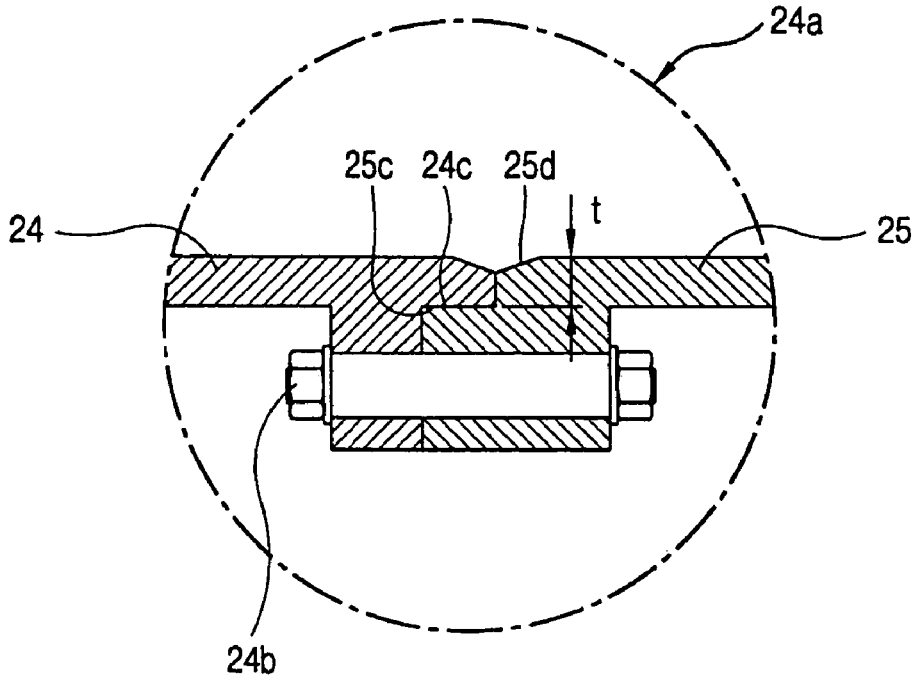
FIG. 3 is an enlarged cross sectional view of part 'B' of FIG. 1.
Figure 4:
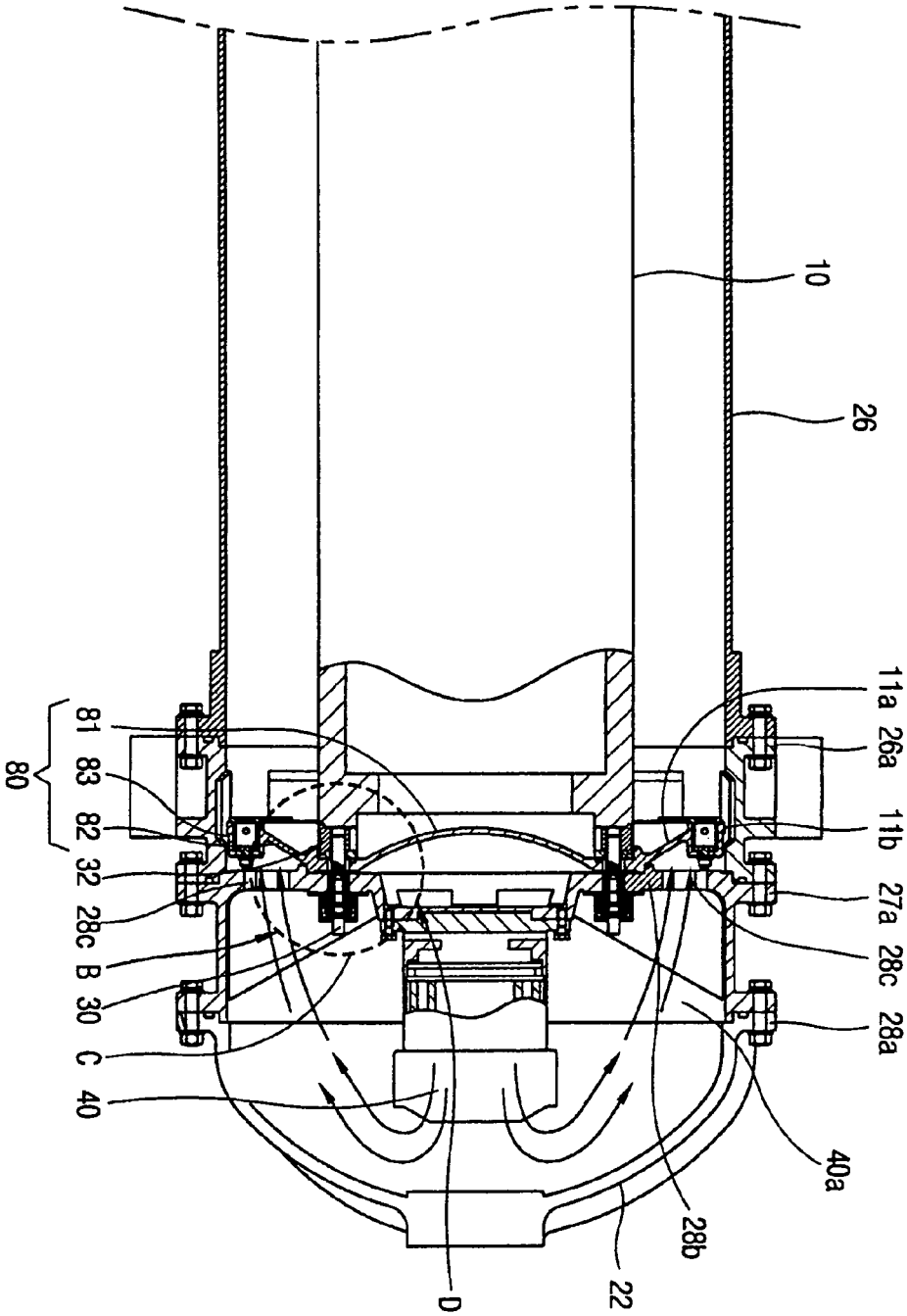
FIG. 4 is an enlarged cross sectional view of part 'A' of FIG. 1.

In the procedure of forming the canister 20 by the plurality of tubes 23 to 27 and the missile restraining tube 28, no protruding part should be formed on an inner wall 20*b* of the connecting parts 23*a* to 28*a* between the tubes 23 to 28, so that the missile 10 can move smoothly. This is because, in case any protruding part is formed, an interference with the obturator 80 moving along with the missile 10 is produced and an unnecessary pressure loss is also caused. For this reason, in the connecting parts 24*a* to 28*a* of the respective tubes 23 to 28, as shown in FIG. 3, coupling grooves 24*c* and 25*c* are dovetailed. Protuberances formed on the tubes 23 to 28 and on the end of front cover 21 are inserted into the grooves formed in adjacent tubes 24 to 28 and in rear cover 22 and are engaged by bolts 24*b* and 28*b*, and a chamfer or tapered recess 25*d* is formed on adjacent mating parts of the interiors of the tubes 23 to 28, thereby eliminating any protruding interior surface on the connecting parts 23*a* to 28*a*.

Among the plurality of tubes 23 to 28, the supporting tube 27 is provided at an outer peripheral surface thereof with a supporter 27*b* for easily placing or laying the ejection system 1 on a launcher. Further, the missile restraining tube 28 is provided with the partition wall 28*b* dividing the canister 20 into the first chamber I and the second chamber II. Around the partition wall 28*b* with a constant interval therebetween, multiple gas discharge through holes 28*c* are arranged serving as orifices or passages enabling a high pressure gas from the second chamber II to push the obturator 80 located on the first chamber I.

Figure 5:
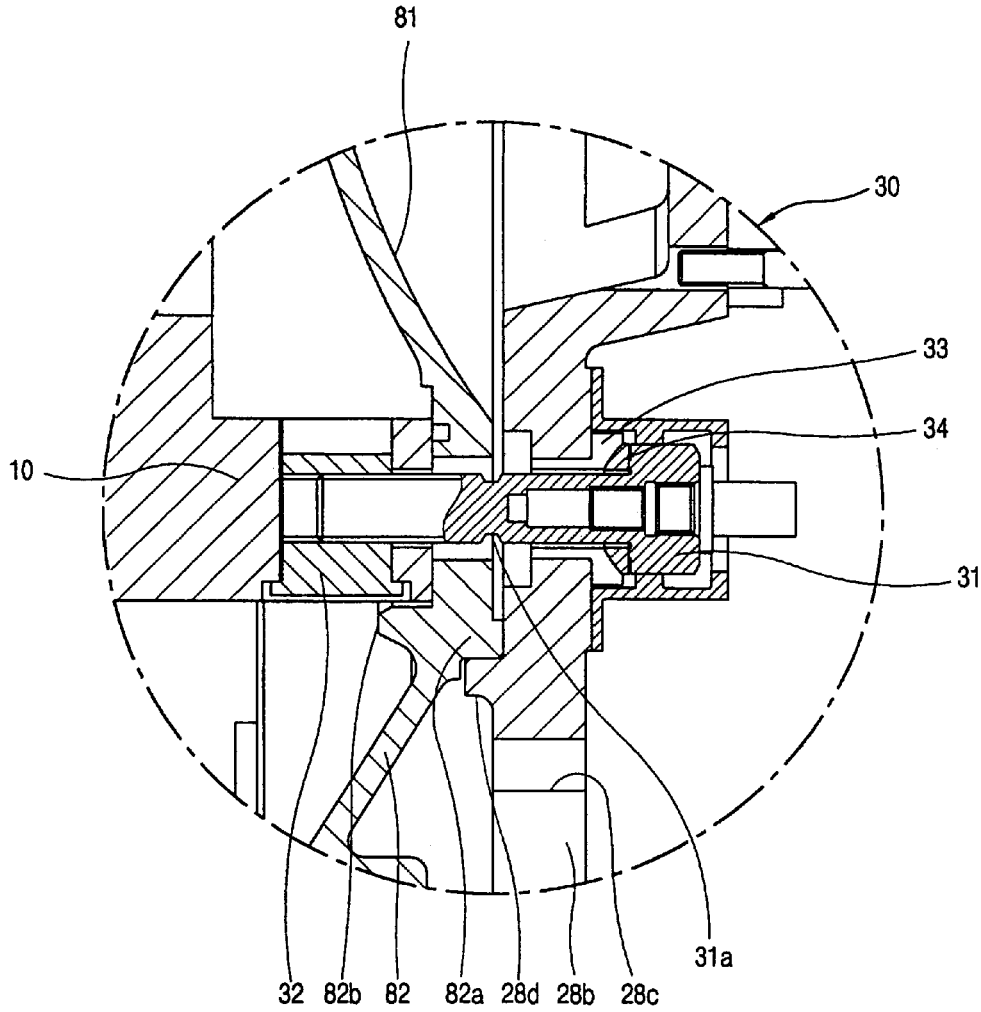
FIG. 5 is an enlarged cross sectional view of part 'C' of FIG. 4.
Figure 6:
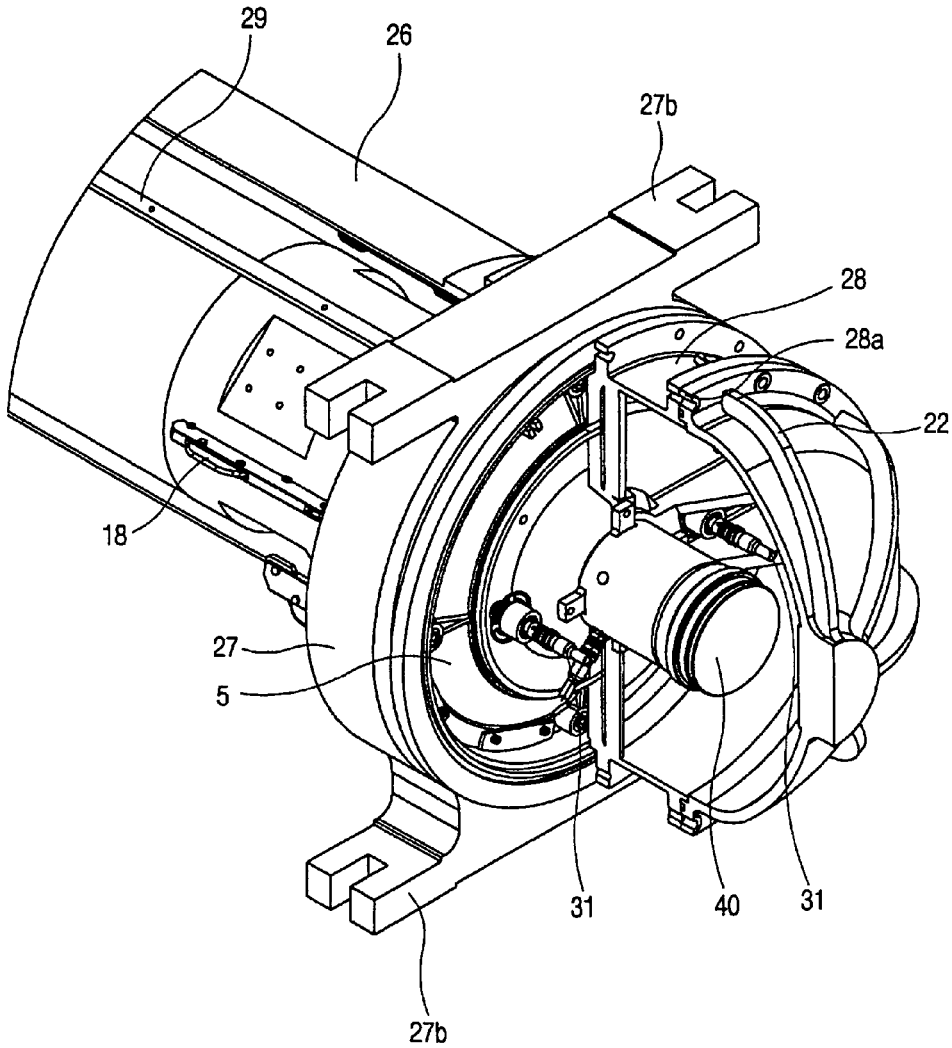
FIG. 6 is an enlarged perspective view of part 'A' of FIG. 1.
Figure 7:
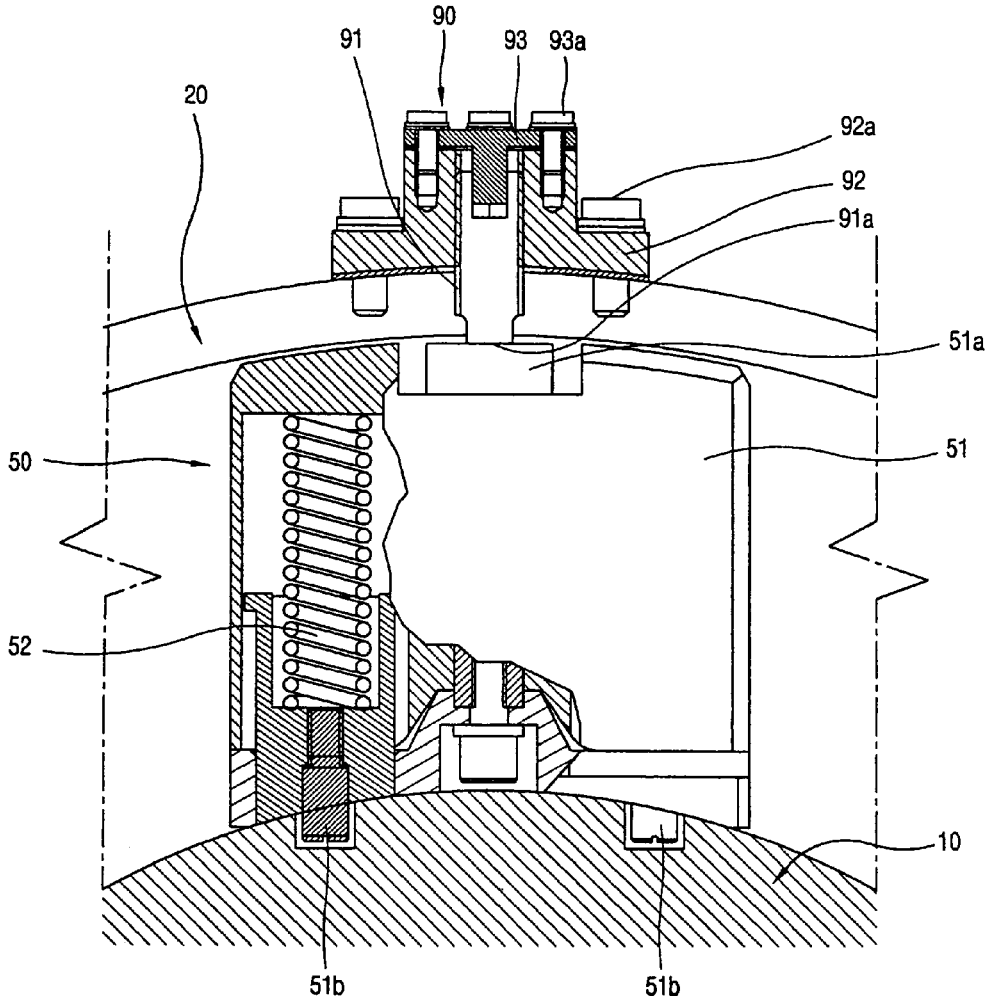
FIG. 7 is a side cross sectional view illustrating the construction of a sabot and of an immobilizer of a canister of the missile ejection system of FIG. 1.
Figure 13:
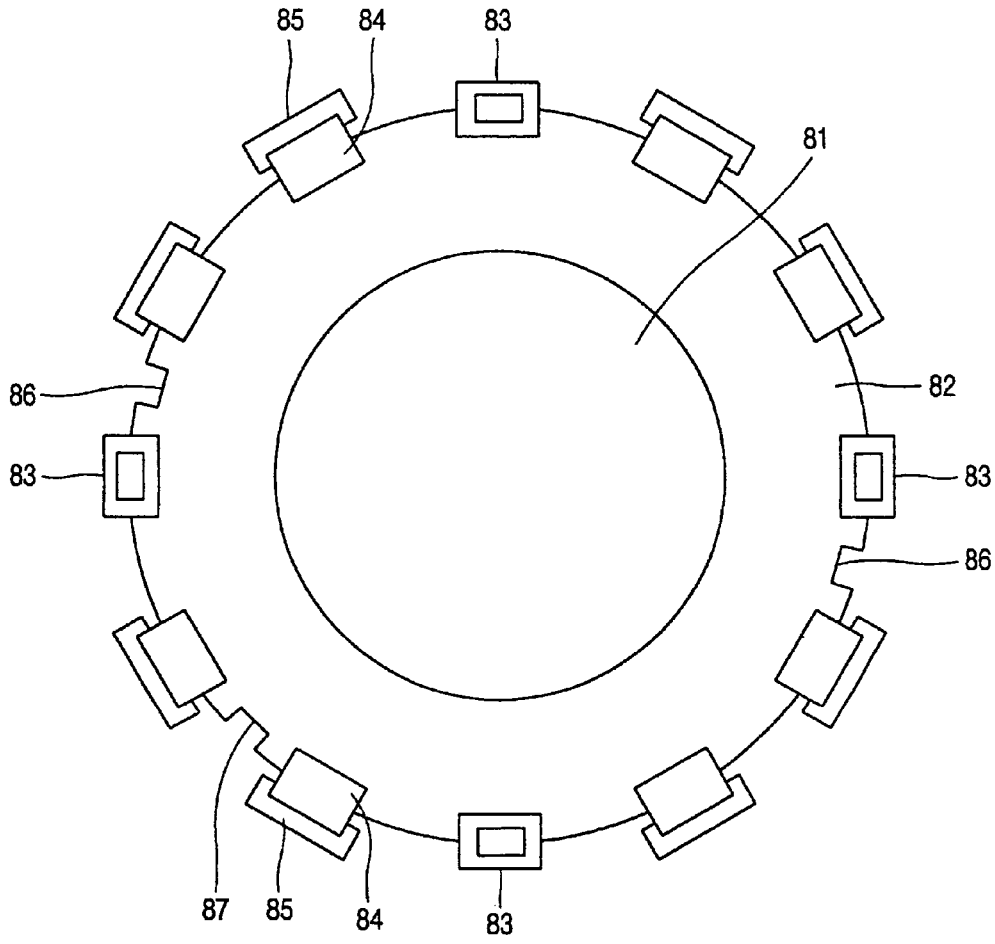
FIG. 13 is a front view illustrating the construction of the obturator of the missile ejection system of FIG. 1.

The obturator 80 is fixed at the tail end of the missile 10 so as to be moved integrally with the missile 10 in the canister 20. That is, as shown in FIG. 5, a first protuberance 28*d* is protruded on the partition wall 28*b* for surrounding a rear protruding part 82*a* of the obturator 80 and mounting the same within the first protuberance 28*d*. A second protuberance 82*b* is protruded on the front surface of the obturator 80 for surrounding a protruding part of the tail end of the missile 10, whereby the obturator 80 is engaged between the tail end of the missile 10 and the front surface of the partition wall 28*a* without using any fastening mechanism and thus the tail end of the missile 10 is restrained in a transverse direction. As shown in FIG. 13, the obturator 80 includes a sealing plate 81 formed with a concave surface curved toward the fore-end 10*a* of the missile 10 so as to enclose the tail end of the missile 10, a radially extended skirt plate 82 extending from the circumference of the sealing plate 81 close to the inner wall of the canister 20 so as to be sloped in a direction toward the fore-end 10*a* of the missile 10, snatchers 83 arranged around the circumference of the skirt plate 82 at a 90° interval, guides 84 arranged at proper intervals between the snatchers 83 on the circumference of the skirt plate 82 so as to guide the launching of the missile 10 by contacting between the obturator 80 and the inner wall of the canister 20, guide grooves 86 formed in the circumference of the skirt plate 82 so as to suppress the rolling motion of the obturator 80 and the missile 10 by engaging with guide rails 29 and grooves 87 formed so as to avoid an interference with friction pins 91 of immobilizers 90.

Figure 11:
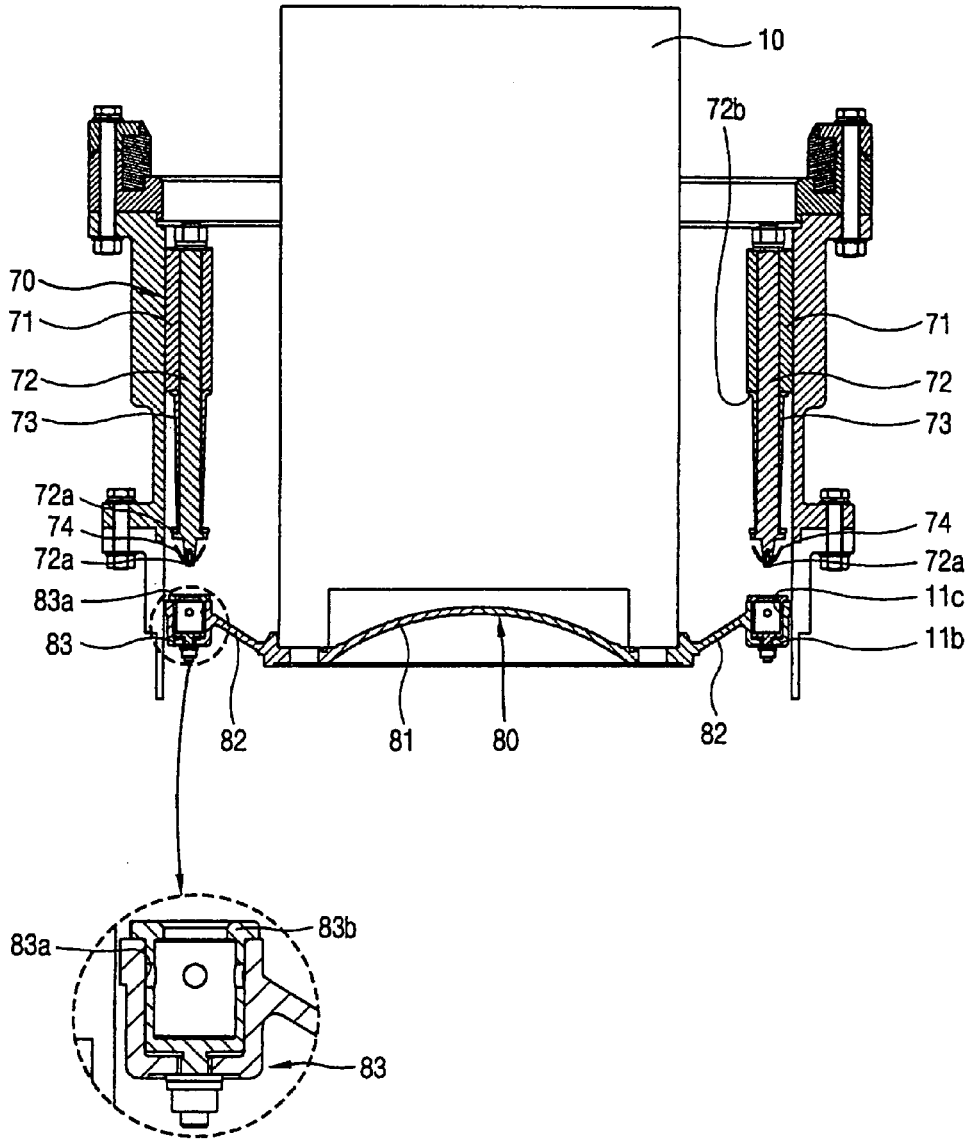
FIG. 11 is a side cross sectional view illustrating an inoperative state of the obturator separator of the missile ejection system of FIG. 1.

Herein, as shown in FIG. 11, the snatchers 83 are provided with recessed receiving parts 83*a*, and protruding parts 83*b* at the openings of the receiving parts 83*a* having a smaller inner diameter than the width of the receiving parts 83*a* are formed on the openings of the receiving parts 83*a*.

Teflon clips 85 are mounted on the external surfaces of the guides 84 in contact with the inner wall of the canister 20 in order to reduce a frictional force. Thus, the missile 10 is capable of smoothly traveling along the inner wall 20*b* of the canister 20 in the process of being released from the canister 20.

The detent 30 includes a bolt 31 through the partition wall 28*b* of the missile for restraining tube 28. With the bolt 31 passing through the partition wall 28*b*, one end thereof is fitted in a self-aligning connector 32 placed on the tail end of the missile 10 and the other end thereof is engaged at the tail end of the partition wall 28*b*, whereby the bolt 31 serves to restrain the missile 10 in the longitudinal direction of the missile 10 in the canister 20 from any disturbance before launching of the missile 10. More specifically, the self-aligning connector 32 is freely rotatable in the transverse direction (i.e., a direction perpendicular to the axial direction) of the bolt 31 and thus enables the end of the bolt 31 to rotate freely in the transverse direction. Also, since a flat surface of a semi-spherical washer 34 is in contact with the head portion of the bolt 31, and since a curved surface of the semi-spherical washer 34 is placed in contact with a curved surface of a bushing 33 inserted between the partition wall 28*b* and the bolt 31, the bolt 31 is capable of rotating freely, and thus the bolt 31 is always given only a tensile force. In case that the missile is to be ejected, by supplying a current though the bolt 31 (not shown in the Figure) right before launching of the missile, the area 31*a* having smaller diameter is broken in advance.

The gas generator 40 has a small quantity of a highly efficient propellant stored in an inner chamber thereof, and is fastened and secured at four places 41 to the center part of the partition wall 28*b*. When a launching signal of the missile 10 is inputted from the outside, high pressure gas is discharged toward the rear cover 22, the enclosed space of the second chamber II is filled with the high pressure gas to build a pressure therewithin, the filled high pressure gas flows to the first chamber I through the plurality of gas discharge through holes 28*c* penetrating around the partition wall 28*b* in the direction of the arrows indicated at 40*a* and pushes against the rear surfaces of the sealing plate 81 and skirt plate 82 of the obturator 80, thereby urging the missile 10 to start moving in the canister 20.

Herein, with the enclosed space formed between the gas outlet of the gas generator 40 and the obturator 80 in order to minimize the leakage of the high pressure gas from the gas generator 40, the efficiency of the gas generator 40 can be maximized. Therefore, the obturator 80 enclosing the tail end of the missile 10 is effectively formed in a concavedly curved shape similarly to a semi-spherical shape or semi-elliptical shape. That is, as the sealing plate 81 of the obturator 80 is formed with a curved surface, it becomes a structure capable of supporting a big force with a smaller thickness. And, as the convex side of the curved surface of the sealing plate 81 is toward the fore-end 10*a* of the missile 10, the obturator 80 occupies almost no space in the longitudinal direction of the missile 10, thereby enabling to reduce the length of the canister 20. Further, the skirt plate 82 is formed at an angle of inclination toward the fore-end 10*a* of the missile 10. Thus, if some bending is generated between the sealing plate 81 and the skirt plate 82 due to the pressure of the high pressure gas, a clearance between the missile 10 and the canister 20 becomes slightly bigger, thereby allowing smooth moving of the missile 10 forwardly.

In the sabots 50, pins 51*b* are fitted in the grooves recessed in the outer peripheral surface of the missile 10. In other words, the pins 51*b* are not fastened but are only inserted into the grooves in the missile 10. Each sabot 50 is provided with an external case 51 formed of nylon and with springs 52 which are installed in a normally compressed condition therewithin. Consequently, the sabots 50 are released when the missile 10 is expelled from the canister 20, and, thereafter, the sabots 50 can be separated from the missile 10 by the elastic force of the expanding springs 52.

Figure 8:
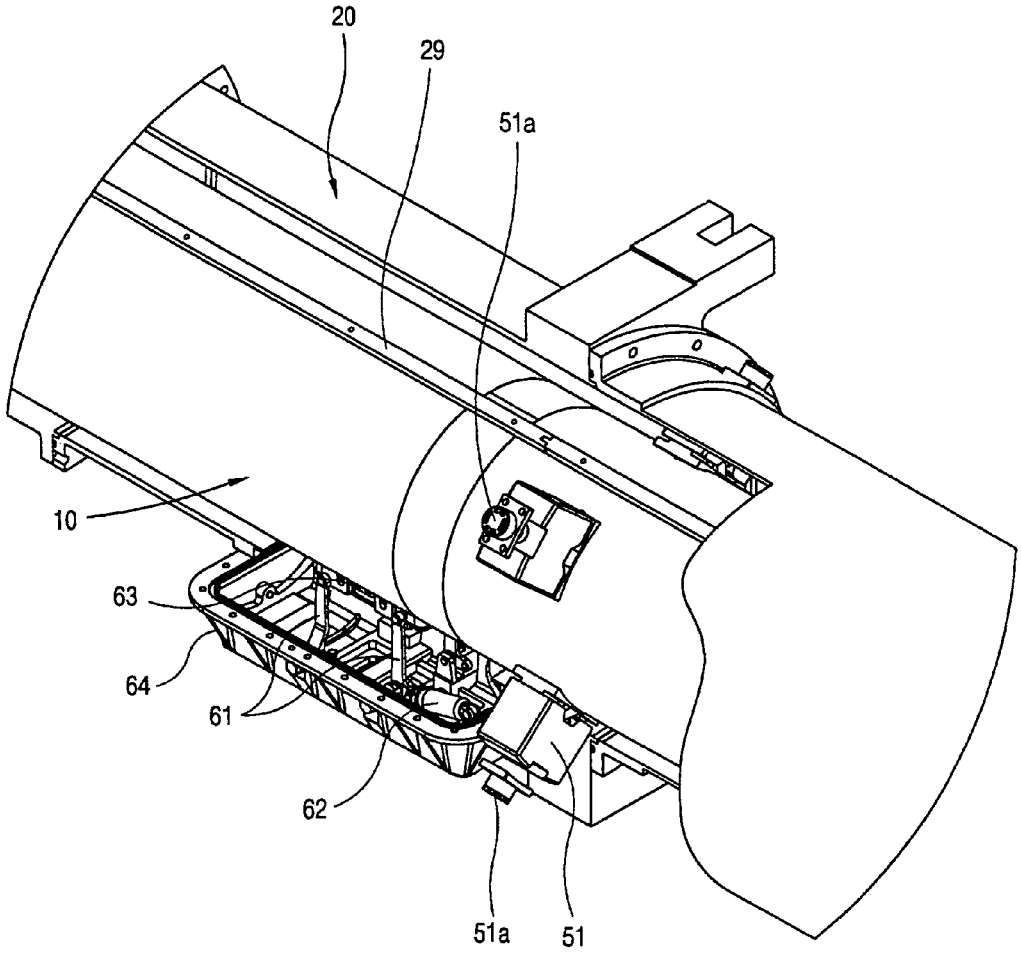
FIG. 8 is a partially cutaway perspective view of parts of the canister of the missile ejection system of FIG. 1.

As shown in FIG. 8, the immobilizers 90 are apparatuses which are formed at 90° intervals at four places on the outer peripheral surface of the missile 10, and which protect the missile 10 by adjusting the clearance between the canister 20 and the missile 10, so that the clearance between the sabot 50 and the immobilizers 90 become the minimum and relative motion does not occur therebetween even when the missile 10 mounted in the canister 20 is fluctuated in a transverse direction during transportation or the like. The immobilizers 90 are each provided with a main body 92 secured to the canister 20 and comprise a friction pin 91 placed in the main body 92 with a predetermined contact force with the corresponding sabot 50, a clamping bolt 91*a* clamping the main body 92 to the canister 20, and a main body cover 93 formed for preventing the release of the friction pin 91. As a contact surface is formed between the bottom surface 91*a* of the friction pin 91 and the main body surface 51*a* of the sabot 50, they are kept contacted by friction based on a normal force.

Accordingly, if a force overcoming the friction between the contact surface 51*a* of the sabots 50 and the friction pin 91 is applied with respect to the longitudinal direction of the missile 10, the restraining state by the immobilizers 90 can be released.

Figure 9:
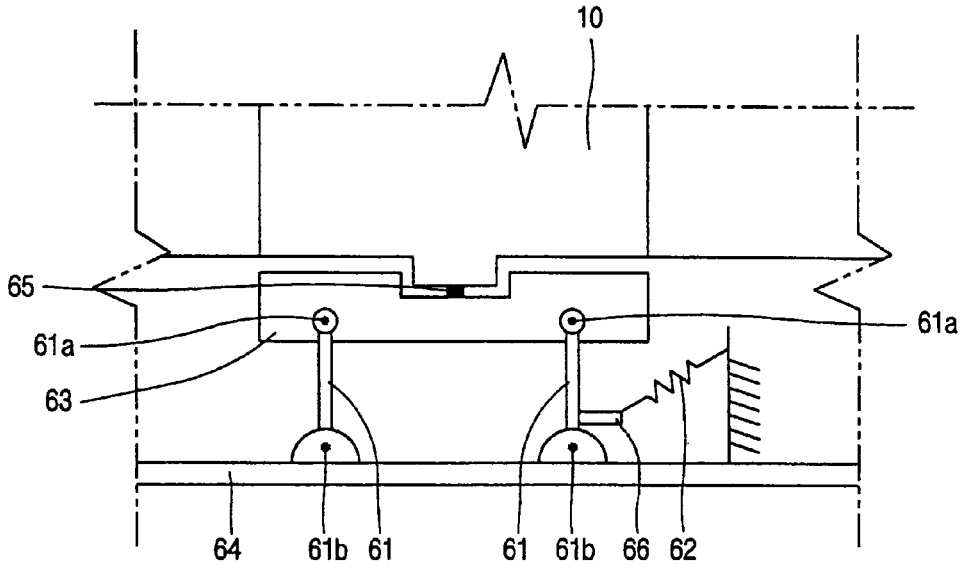
FIG. 9 is a side schematic view illustrating the construction of a umbilical cable separator of the missile ejection system of FIG. 1.

The umbilical cable separator 60 is constructed in a manner to smoothly separate the umbilical cable 65 of a nib connector 63 from the missile 10 when the missile 10 is launched. As shown in FIGS. 8 and 9, the umbilical cable separator 60 includes connection links 61 having opposite ends 61*a* and 61*b* thereof respectively hinge-coupled to the body of the nib connector 63 and to a casing 64 and all having the same length, a compressed spring 62 connected between the casing 64 and one of the connection links 61 for preventing the connection link 61 from moving by more than a predetermined extent, the casing 64 surrounding the umbilical cable separator 60, and the umbilical cable 65 being connected between the missile 10 and the nib connector 63.

Herein, as the lengths of the connection links 61 are all the same, thus the nib connector 63 is able to keep parallel to the inner surface of the casing 64 regardless of the motion of the connection links 61. The one of the connection links 61 is connected to the coil spring 62 via the end of a link 66 formed in an L-shape and protruded therefrom, and the spring 62 applies such a force that it urges the connection link 61 to normally stand upright whereby the nib connector 63 is kept firmly coupled to the missile 10. Moreover, when the missile 10 is launched and travels in the longitudinal direction, the nib connector 63 moves along with the missile 10 while keeping parallel thereto. With the movement, when the missile 10 moves upwardly over some extent, nib connector 63 cannot follow the missile 10 due to the length limitation of the connection links 61, and thus, the umbilical cable 65 becomes disconnected with the nib connector 63, and the spring 62 applies a force in such a direction that the connection links 61 are laid onto the inner surface of the casing 64 (i.e., to the left direction as shown in FIG. 9), thereby keeping the connection links 61 and the nib connector 63 lying onto the casing 64.

Figure 10:
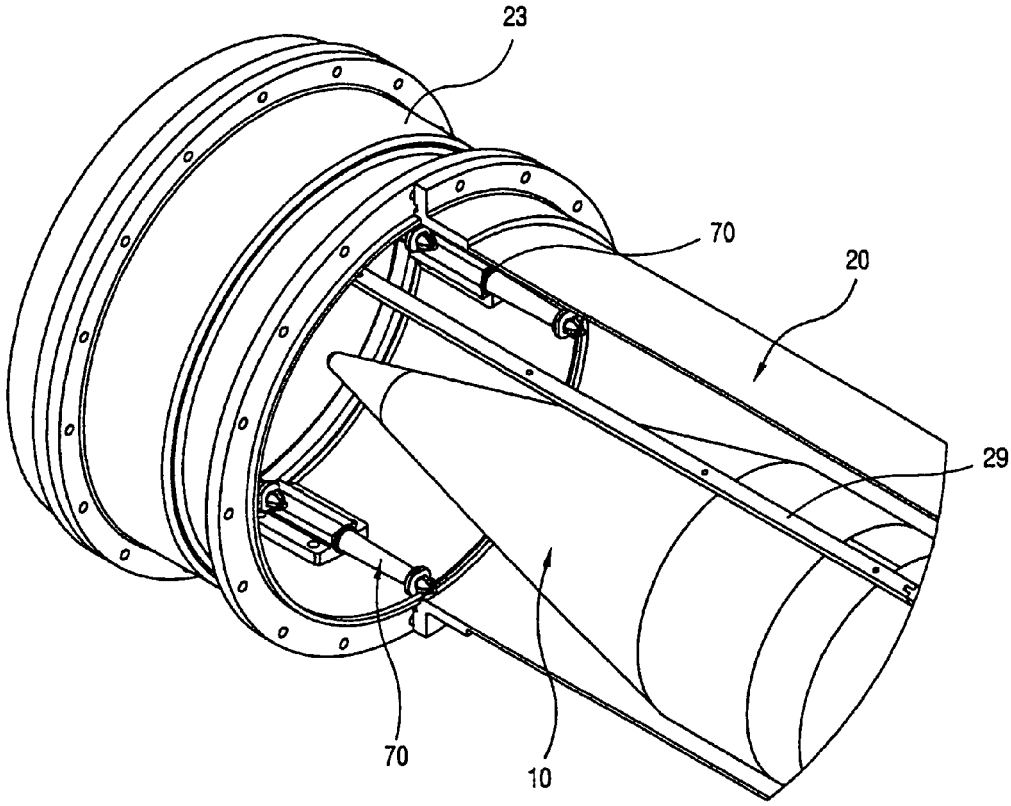
FIG. 10 is a side cross sectional view illustrating the construction of an obturator separator of the missile ejection system of FIG. 1.
Figure 12:
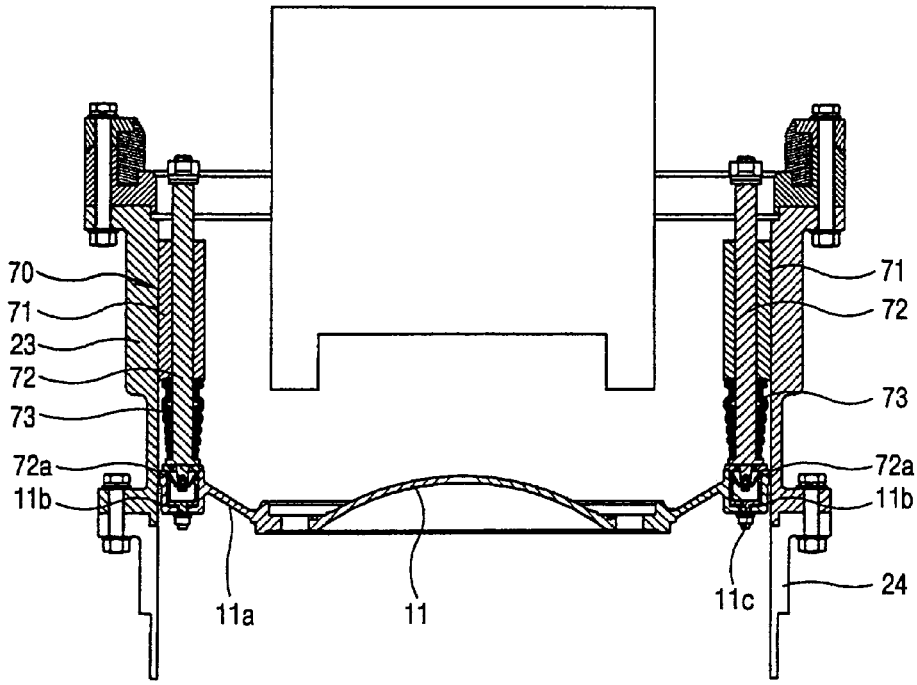
FIG. 12 is a side cross sectional view illustrating an operative state of the obturator separator of FIG. 10.

The obturator separator 70 is provided for eliminating the possibility that the obturator 80 falls down on the ground and damages ground equipment and neighboring canisters when the missile is expelled out of the canister. More concretely, when the missile 10 is released from the canister 20 with the obturator 80 mounted on the tail end thereof, the missile 10 is firstly launched by the gas pressure created in the canister by the gas generator 40, and then the missile 10 expelled out of the canister 20 is secondly launched toward a target by a propulsion engine mounted in the missile 10. As shown in FIGS. 10 to 12, the ejection separator 70 includes a plurality of holders 71 mounted at spaced intervals on the inner surface of the stopping tube 23 of the canister 20, a stop bar 72 held within each holder 71, a shock absorber 73 made of metal installed surrounding the periphery of each of stop bars 72 in the shape of a conical tube, and a V-shaped plate spring 74 mounted on the end 72*a* of the front part of each of the stop bars 72.

By the aforementioned construction, while the missile 10 travels together with the obturator 80 within the canister 20, the receiving parts 83*a* of the snatchers 83 of the obturator 80 are aligned with the stop bars 72 respectively. Therefore, as the missile 10 travels further, as shown in FIG. 12, the ends of the stop bars 72 begin to enter the corresponding receiving parts 83*a* of the snatchers 83, and then the shock absorption parts 73 are compressed as the missile travels further for thereby absorbing the kinetic energy by the deformation of the shock absorption parts 73. Then, when the obturator 80 can no longer move together with the missile 10 because of the interference with the snatchers 83, the obturator 80 is separated from the tail end of the missile 10. Herein, the V-shaped plate springs 74 are contracted when the stop bars 73 begin to enter the receiving parts 83*a*, and then the V-shaped plate springs 74 can become inserted into the receiving parts 83*a*. As the rear part of each of the V-shaped plate springs 74 is engaged with the corresponding protruding part 83*b*, the obturator 80 will not drop down to the bottom part of the canister 20 but will be hung on the obturator separator 70 thereby being secured within canister 20 for enabling to reuse it.

Hereinafter, the operating principle of the present invention will be described.

In the event the missile 10 is transported, after being placed in the missile ejection system 1 in accordance with the present invention, even if an external shock is applied thereto, it is possible to prevent the missile 10 from relatively moving within the canister 20 by the detents 30 longitudinally securing the missile 10 and the immobilizers 90 respectively securing the missile longitudinally and transversely.

In the event the missile 10 is launched using the ejection system 1 in accordance with the present invention, when a launching signal is transferred to the missile 10 through the umbilical cable 65, the detents 30 longitudinally restraining the missile 10 are broken, and when high pressure gas is blown off from the gas generator 40 into the enclosed space between the obturator 80 mounted on the tail end of the missile 10 and the gas generator 40, the missile 10 starts to move within the canister 20. At this time, the front cover 21 is broken at an initial stage since the gas pressure is partially transferred thereto. With the traveling of the missile 10, a frictional contact between the friction pins 91 of the immobilizers 90 laterally restraining the missile 10 and the sabots 50 is released. And, the connection links 61 of the umbilical cable separator 60 also undergo a rapid rotary motion by the urging of the spring 62, to thus separate an electrical connection between the nib connector 63 and the missile 10.

Regarding the traveling of the missile 10 in the canister 20, since the obturator 80 moves along the guide rail 29 formed lengthwise upon the inner wall of the canister 20, the missile 10 engaged to the obturator 80 cannot move in a rolling direction within the canister 20. At the same time, the obturator 80 is also restrained not to move in the rolling direction, and thus the snatchers 83 of the obturator 80 are precisely engaged with the stop bars 73 of the ejection separators 70. Further, with the missile 10 being almost released from the canister 20, the obturator 80 mounted at the tail end of the missile 10 is separated from the missile 10 by the obturator separators 70, and the V-shaped plate springs 74 at the front parts of the stop bars 73 are inserted into the receiving parts 83*a* of the snatchers and hung therein, thereby making the obturator 80 remain hung on the front part of the canister 20 without dropping down to the bottom of the canister 20. Then, the missile 10 released from the canister 20 is launched toward a target by its propulsion engine. Meanwhile, in order to absorb or disperse a launching shock, it is preferred to perform launching with the rear cover 22 being contacted to the ground. The missile 10 is accelerated while passing through the canister 20, and the missile 10 is released out of the canister 20 at the maximum speed the moment the missile 10 reaches to the front end of the canister 20.

As the present invention may be embodied in various forms without departing from the spirit or essential characteristics thereof, it should also be understood that the above-described embodiment is not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

As explained above, in accordance with the present invention, there is provided a missile ejection system which is able to effectively release a missile from a canister by employing a gas generator without using a missile propulsion engine, by having an obturator formed in a concavedly recessed curved shape toward the front part of the missile and forming an enclosed space between the obturator and a rear cover, thereby fundamentally preventing damage to ground equipment or peripheral missiles.

Furthermore, the system of the present invention may comprise one or more guides extending from the obturator for preventing control fins 18 of the missile from impacting the inner wall of the canister by making the guides slide along the inner wall of the canister during the traveling of the missile. Moreover, the canister of the missile ejection system in accordance with the present invention is made up of a combination of a plurality of tubes joined end-to-end, whereby it is made possible to manufacture the canister without using any heavy machine tools, a defect rate is lowered to reduce the manufacturing cost, and it becomes much easier to handle and assemble.

Furthermore, the system of the present invention may comprise one or more guide rails formed along the longitudinal direction in the canister for preventing the rolling motion of the missile upon launching of the missile, and one or more detents engaged to the rear end of the missile for longitudinally restraining the missile in the canister even under an external shock. Moreover, the system of the present invention may further comprise one or more immobilizers for transversely restraining the missile, whereby there occurs no relative motion between the missile and the canister even under an external vibration or shock before launching the missile.

Furthermore, the system of the present invention may comprise one or more obturator separators for preventing the obturator from being released from the canister, thereby being able to eliminate damage to ground objects which could occur in the event the obturator was released from the canister along with the missile and subsequently separated in the air by action of a missile propulsion engine. Further, the obturator is constructed in a manner so as not to be released from the canister but hung on the obturator separators, thereby being able to completely eliminate the possibility of damage to the canister which could occur in the event the obturator was separated and dropped down in a vertically raised canister.

What is claimed is:

1. A missile ejection system, comprising:

a canister formed as a cylindrical shell;

a partition wall protruding from an inner wall of the canister so as to divide the canister into a first chamber housing a missile therewithin and a second chamber, and having at least one hole therethrough for allowing the flowing of gas through the partition wall;

a gas generator secured to the partition wall in the second chamber so that a gas outlet thereof in an opposite direction from the first chamber; and an obturator including a sealing plate formed with a concave surface toward a fore-end of the missile for enclosing a tail end of the missile, and a radially extending skirt plate extended from the circumference of the sealing plate to the inner wall of the canister and inclined toward the fore-end of the missile for covering the space between the missile and the inner canister, wherein the missile is propelled by the pressure of the gas discharged out of the gas generator from the second chamber to the first chamber through the hole, being pressurized by the flown-in gas in the first chamber, pushing upon the obturator.

2. The system of claim 1, further comprising at least one guide formed on the outer circumference of the skirt plate so that the outer circumference thereof is in contact with the inner wall of the canister.

3. The system of claim 2, wherein the surface of the guide in contact with the inner wall of the canister is coated by Teflon.

4. The system of claim 2, wherein a Teflon clip is mounted on the surface of the guide in contact with the inner wall of the canister.

5. The system of claim 2, wherein the partition wall is formed integrally with the canister.

6. The system of claim 2, wherin the missile ejection system comprises an obturator separtor including:

at least one stop bar provided on the inner surface of the canister;

at least one snatcher formed intergrally an outer circumference of the skirt plate of the obturator and having a receiving part which is aligned with the stop bar so as to receive and engage the stop bar as the missile is ejected from the canister

7. The system of claim 6, wherein the stop bar further comprises a deformable member absorbing a shock between the stop bar and the snatcher.

8. The system of claim 6, wherein a V-shaped plate spring is provided at a front end of each stop bar, which can be snatcher. contracted and locked with the snatcher when the stop bar is in contact with the receiving part of the snatcher.

9. The system of claim 1, wherein the canister consists of a front cover, a rear cover and a plurality of tubes connected end-to-end between the front cover and the rear cover.

10. The system of claim 9, wherein a groove or a tongue engaged each other is formed on the engaging ends surface of each of the respective tubes.

11. The system of claim 9, wherein a tapered recess is formed in the inner walls at ends of the adjacent tubes.

12. The system of claim 9, wherein the canister constituting the second chamber comprises:

a missile restraining tube connected to the tube constituting the first chamber, provided with an open end and formed integrally with the partition wall; and a rear cover;

wherein the second chamber is defined between the partition wall and the rear cover.

13. The system of claim 9, wherein a support part is formed on at least two of the tubes thereof for enabling mounting or laying of the canister on a launcher.

14. The system of claim 1, wherein the missile ejection system further comprises at least one guide rail formed inside the canister in the longitudinal direction of the canister and engaged by corresponding guide means of the missile in order to prevent a rolling motion of the missile within the canister.

15. The system of claim 14, wherein the guide means comprises the skirt plate of the obturator having at least one guide part which engages the corresponding guide rail.

16. The system of claim 1, wherein the missile ejection system further comprises at least one detent engaging the tail end of the missile for restraining the missile in the longitudinal direction.

17. The system of claim 1, wherein the missile ejection system further comprises at least one immobilizer for restraining the missile in a transverse direction, which is in contacted with a corresponding sabot protruding on the outer peripheral surface of the missile.

18. The system of claim 14, wherein each immobilizer further comprises a friction pin urged in contact with the outer peripheral surface of the corresponding sabot.

19. The system of claim 1, wherein the missile ejection system further comprises an umbilical cable separator including:

a connector connected with a peripheral surface of the missile so as to carry electric signals between the missile and the outside of the missile; and at least one connection link hinge-coupled between the connector and the inner surface of the canister;

wherein, during the missile's launching, the connector connected with the missile moves with the missile and then the connector becomes disconnected from missile when the connector cannot follow the missile any longer due to the limitation of the length of the connection link.

* * * * *